US007384115B2

(12) United States Patent
Barkley

(10) Patent No.: US 7,384,115 B2
(45) Date of Patent: Jun. 10, 2008

(54) METHOD FOR CONTROLLING A PRINTHEAD

(75) Inventor: Lucas D. Barkley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 464 days.

(21) Appl. No.: 11/216,811

(22) Filed: Aug. 31, 2005

(65) Prior Publication Data

US 2007/0046711 A1 Mar. 1, 2007

(51) Int. Cl.
*B41J 29/38* (2006.01)

(52) U.S. Cl. ..... 347/17; 347/60

(58) Field of Classification Search ..... 347/17, 347/60
See application file for complete search history.

(56) References Cited

U.S. PATENT DOCUMENTS 6,312,079 B1 * 11/2001 Anderson et al. ..... 347/12
6,478,396 B1 * 11/2002 Schloeman et al. ..... 347/12

* cited by examiner

*Primary Examiner*—Thinh Nguyen
(74) *Attorney, Agent, or Firm*—Taylor & Aust, P.C.

(57) ABSTRACT

A method for controlling a printhead for printing and maintaining a desired operating temperature of the printhead during the printing, the printhead having a plurality of ink ejectors and a plurality of addresses employed for ejecting ink from the plurality of ink ejectors, wherein each address of the plurality of addresses corresponds to a particular subset of the plurality of ink ejectors, includes configuring a binary intensity word for applying non-nucleating heating to selected ink ejectors of the plurality of ink ejectors of the printhead; repeatedly sequentially cycling through the plurality of addresses for the printing with the printhead; and repeatedly applying the binary intensity word while performing the repeated sequentially cycling through the plurality of addresses.

20 Claims, 7 Drawing Sheets

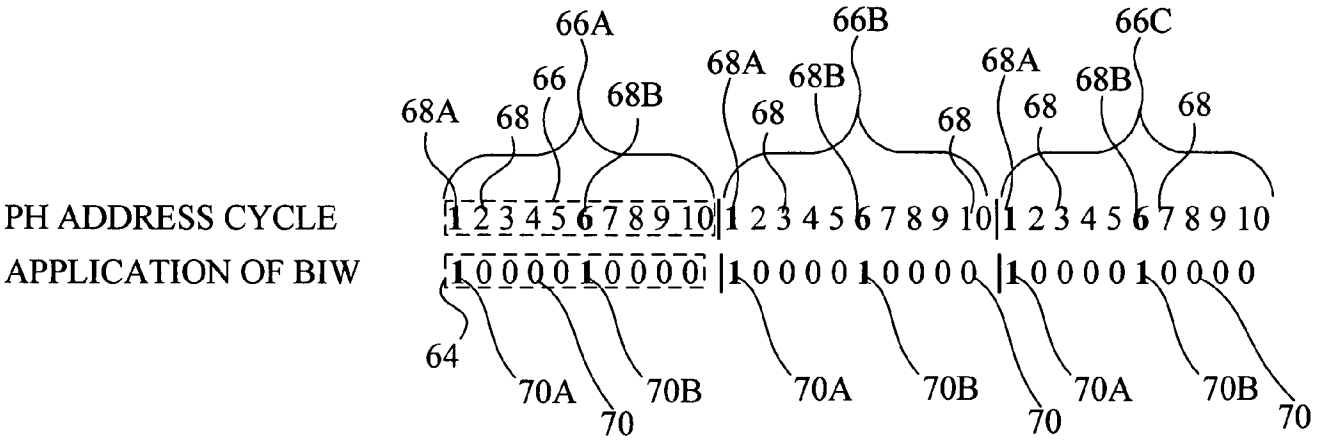
PH ADDRESS CYCLE
APPLICATION OF BIW
1 2 3 4 5 6 7 8 9 10
1 0 0 0 0 1 0 0 0 0
1 0 0 0 0 1 0 0 0 0
1 0 0 0 0 1 0 0 0 0

FIRMWARE CONTROL

NNH Density Table

79C YELLOW PTR → ENTRY 0

CYAN PTR → 2

79A

79B MAGENTA PTR → 9

| ENTRY | | | | | | | | | |
|---|---|---|---|---|---|---|---|---|---|
| 0 | 0 | 0 | 0 | 0 | 0 | 0 | 0 | 0 | 0 |
| 1 | 0 | 0 | 0 | 0 | 0 | 0 | 0 | 0 | 1 |
| 2 | 0 | 0 | 0 | 0 | 1 | 0 | 0 | 0 | 1 |
| 3 | 0 | 0 | 1 | 0 | 0 | 1 | 0 | 0 | 1 |
| 4 | 0 | 0 | 1 | 0 | 1 | 0 | 1 | 0 | 1 |
| 5 | 1 | 0 | 1 | 0 | 1 | 0 | 1 | 0 | 1 |
| 6 | 1 | 0 | 1 | 0 | 1 | 0 | 1 | 1 | 1 |
| 7 | 1 | 0 | 1 | 1 | 1 | 0 | 1 | 1 | 1 |
| 8 | 1 | 0 | 1 | 1 | 1 | 1 | 1 | 1 | 1 |
| 9 | 1 | 1 | 1 | 1 | 1 | 1 | 1 | 1 | 1 |

76

ADVANCES EVERY PLOAD

CYCLE INDEX

Fig. 6

METHOD FOR CONTROLLING A PRINTHEAD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an imaging apparatus, and more particularly to a method for controlling a printhead for printing and maintaining a desired operating temperature of the printhead during printing.

2. Description of the Related Art

In today's thermal inkjet industry, achieving a desired printhead operating temperature before printing (pre-heat) is desirable in order to achieve acceptable print quality. The desired printhead operating temperature must then be maintained. The temperature may be maintained by using what is known as a substrate heater or by using the ink ejecting heaters to heat the chip by applying an electrical pulse which is not capable of ejecting ink, but is sufficient to heat the substrate at an acceptable rate to achieve operating temperature within an acceptable amount of time, referred to as non-nucleating heating (NNH). NNH heating is a beneficial method of heating for two main reasons: it does not require the additional silicon real estate that substrate heaters do, and it heats the silicon directly at the area of interest, the ink firing chamber (ink ejector).

However, a problem with using NNH heating to pre-heat the printhead is that the life of the heaters in the ink ejectors may be reduced, due to additional use and activity that a substrate heater would otherwise endure.

SUMMARY OF THE INVENTION

The invention, in one exemplary embodiment, relates to a method for controlling a printhead for printing and maintaining a desired operating temperature of the printhead during the printing, the printhead having a plurality of ink ejectors and a plurality of addresses employed for ejecting ink from the plurality of ink ejectors, wherein each address of the plurality of addresses corresponds to a particular subset of the plurality of ink ejectors. The method includes configuring a binary intensity word for applying non-nucleating heating to selected ink ejectors of the plurality of ink ejectors of the printhead; repeatedly sequentially cycling through the plurality of addresses for the printing with the printhead; and repeatedly applying the binary intensity word while performing the repeated sequentially cycling through the plurality of addresses.

The invention, in another exemplary embodiment, relates to an imaging apparatus. The imaging apparatus includes a print engine, a printhead communicatively coupled to the print engine, the printhead having a plurality of ink ejectors; and a controller communicatively coupled to the print engine, the controller being configured to execute instructions for printing using the printhead while maintaining a desired operating temperature of the printhead. The instructions include configuring the binary intensity word for applying non-nucleating heating to selected ink ejectors of the plurality of ink ejectors of the printhead; repeatedly sequentially cycling through the plurality of addresses for the printing with the printhead; and repeatedly applying the binary intensity word while performing the repeated sequentially cycling through the plurality of addresses.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 3 depicts a binary intensity word being applied in parallel to an address cycle.

FIG. 4 depicts a binary intensity word being applied in parallel to an address cycle in accordance with an embodiment of the present invention.

FIG. 6 depicts a non-nucleating density table in accordance with an embodiment of the present invention.

DETAILED DESCRIPTION

Figure 1:
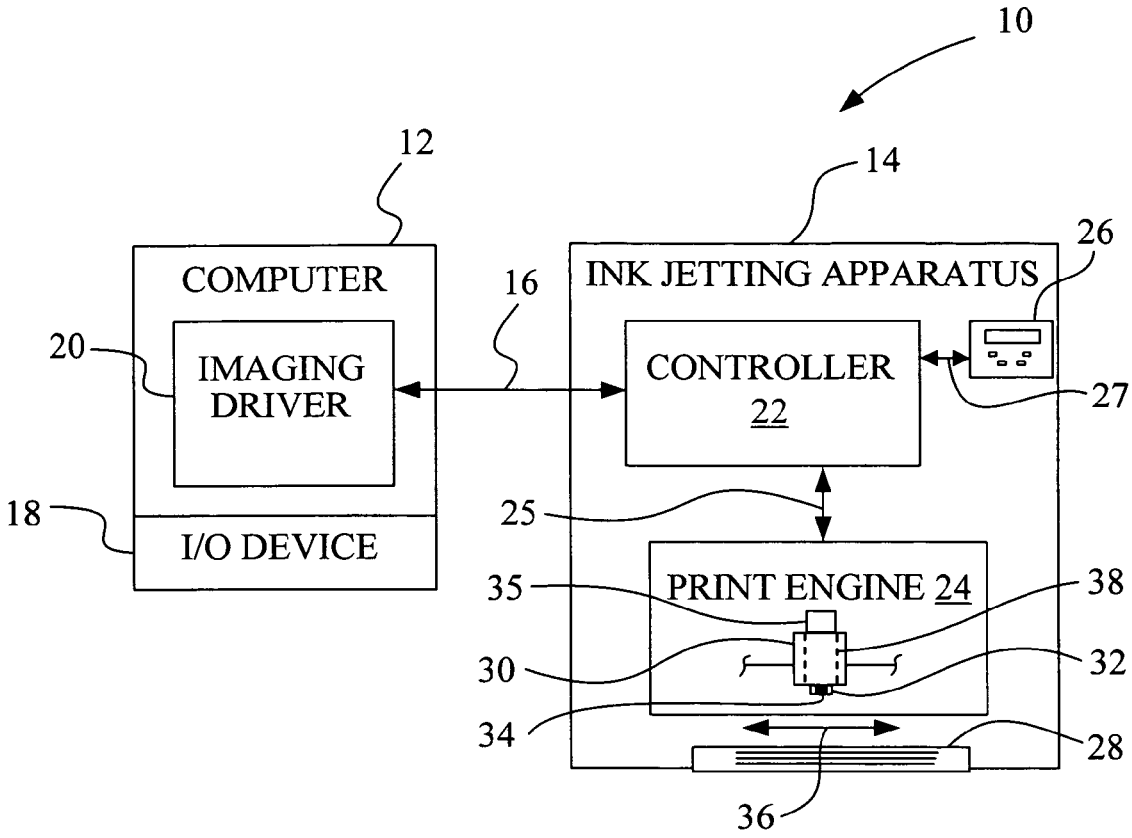
FIG. 1 is a diagrammatic depiction of a system embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Referring to FIG. 1, there is shown a diagrammatic depiction of an imaging system 10 embodying the present invention. Imaging system 10 may include a computer 12 and an ink jet apparatus 14. Ink jet apparatus 14 communicates with computer 12 via a communications link 16. Communications link 16 may be established by a direct cable connection, wireless connection or by a network connection such as for example an Ethernet local area network (LAN).

Alternatively, ink jet apparatus 14 may be a standalone unit that is not communicatively linked to a host, such as computer 12. For example, ink jet apparatus 14 may take the form of an all-in-one, i.e., multifunction, machine that includes standalone copying and facsimile capabilities, in addition to optionally serving as a printer when attached to a host, such as computer 12.

Computer 12 may be, for example, a personal computer including an input/output (I/O) device 18, such as keyboard and display monitor. Computer 12 further includes a processor, input/output (I/O) interfaces, memory, such as RAM, ROM, NVRAM, and a mass data storage device, such as a hard drive, CD-ROM and/or DVD units. During operation, computer 12 includes in its memory a software program including program instructions that function as an imaging driver 20, e.g., printer driver software, for ink jet apparatus 14. Although residing in computer 12, imaging driver 20 is considered herein to be a part of inkjet apparatus 14.

In the example of FIG. 1, ink jet apparatus 14 also includes a controller 22, a print engine 24 and a user interface 26.

Imaging driver 20 of computer 12 is in communication with controller 22 of inkjet apparatus 14 via communications link 16. Imaging driver 20 facilitates communication between ink jet apparatus 14 and computer 12, and may provide formatted print data to ink jet apparatus 14, and more particularly, to print engine 24. Alternatively, however, all or a portion of imaging driver 20 may be located in controller 22 of ink jet apparatus 14. For example, where ink jet apparatus 14 is a multifunction machine having standalone capabilities, controller 22 of ink jet apparatus 14 may include an imaging driver configured to support a copying function, and/or a fax-print function, and may be further configured to support a printer function. In the present embodiment, the imaging driver facilitates communication of formatted print data, as determined by a selected print mode, to print engine 24.

Controller 22 includes a processor unit and associated memory, and may be formed as an Application Specific Integrated Circuit (ASIC). Controller 22 communicates with print engine 24 via a communications link 25. Controller 22 communicates with user interface 26 via a communications link 27. Communications links 25 and 27 may be established, for example, by using standard electrical cabling or bus structures, or by wireless connection.

Print engine 24 may be, for example, an ink jet print engine configured for forming an image on a sheet of print media 28, such as a sheet of paper, transparency or fabric.

Print engine 24 may include, for example, a reciprocating printhead carrier 30, and at least one ink jet printhead 32 having one or more of a printhead temperature sensor 34, for example, printhead temperature sensors 34A, 34B, and 34C. Associated with printhead 32 is a power supply 35 for supplying electrical signals to printhead 32 for printhead warming, and for ink ejection during printing operations. Power supply 35 is depicted in FIG. 1 as being adjacent to the cartridge associated with printhead 32 for purposes of illustration, and may be located at any convenient location, provided that power supply 35 is communicatively coupled to printhead 32.

Printhead carrier 30 transports ink jet printhead 32 and printhead temperature sensor 34 in a reciprocating manner in a bi-directional main scan direction 36 over an image surface of sheet of print media 28 during printing and/or sensing operations.

Printhead carrier 30 may be mechanically and electrically configured to mount, carry and facilitate one or more printhead cartridges 38, such as a monochrome printhead cartridge and/or one or more color printhead cartridges. Each printhead cartridge 38 may include, for example, an ink reservoir containing a supply of ink, to which at least one respective printhead 32 is attached. In order for print data from computer 12 to be properly printed by print engine 24, the RBG data generated by computer 12 is converted into data compatible with print engine 24 and printhead(s) 32.

Figure 2:
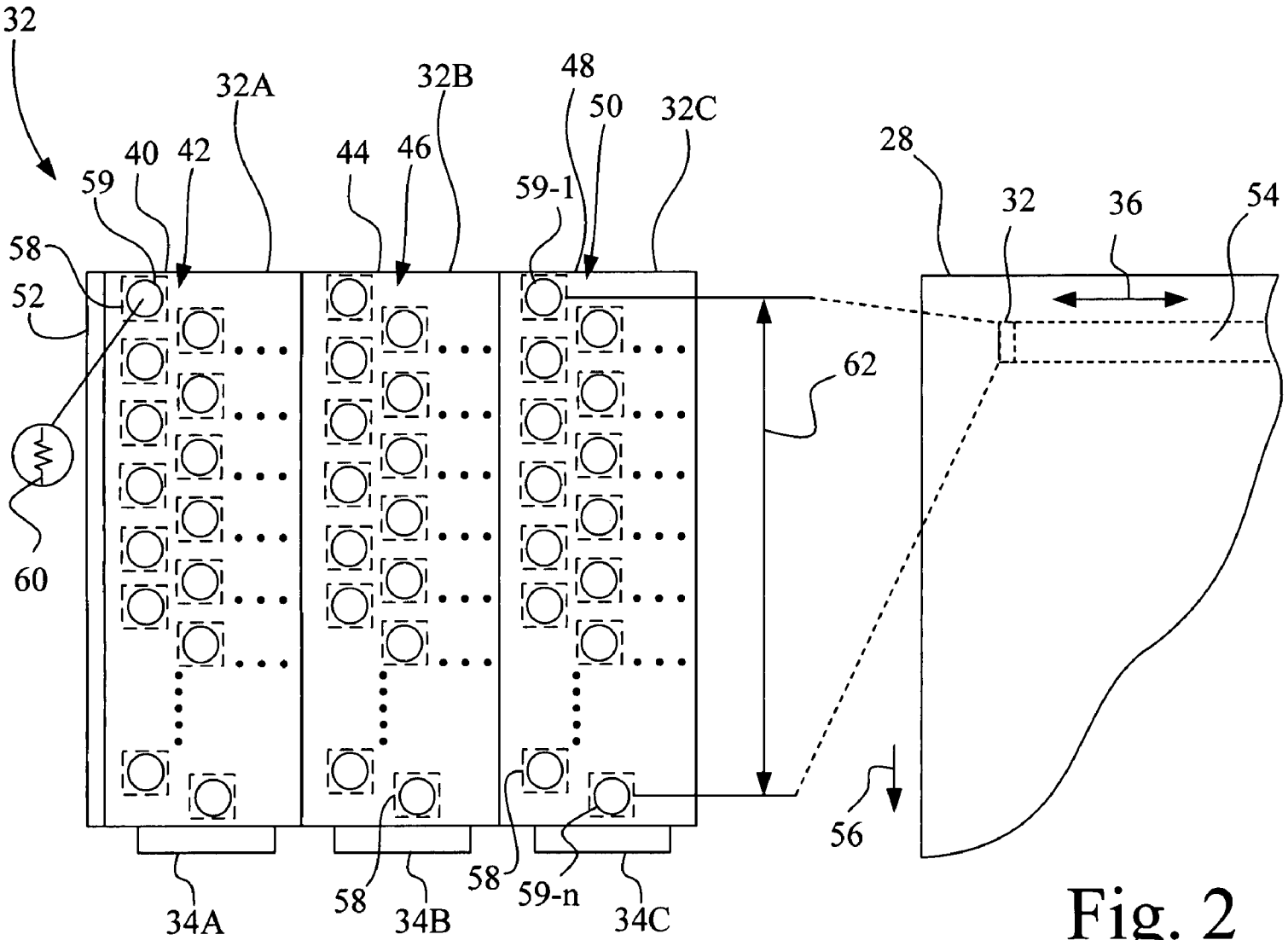
FIG. 2 is an exemplary depiction of the printhead of FIG. 1, with the printhead being projected over a sheet of print media.

Referring now to FIG. 2, in the present embodiment, a single printhead, such as printhead 32, includes a plurality of ink ejectors and a plurality of addresses employed for ejecting ink from the ink ejectors, wherein each address corresponds to a particular subset of the plurality of ink ejectors. Printhead 32 also includes multiple regions, each region having an ink jetting array, with each array associated with one color of a plurality of colors of ink, for example, regions 32A, 32B, and 32C corresponding to cyan, yellow, and magenta inks, respectively. Alternatively, it is contemplated that each array may also be associated with one type of ink of a plurality of types of inks. In another embodiment, printhead carrier 30 may be configured to carry multiple printheads, wherein each printhead pertains to a different color, saturation, and/or ink type, wherein each color, saturation, and/or ink type may constitute a region. For example, in a system using cyan, magenta, yellow and black inks, printhead carrier 30 may carry four printheads, such as printhead 32, with each printhead carrying an ink ejector array dedicated to a specific color of ink, e.g., cyan, magenta, yellow and black.

It will be understood that the regions of printhead 32, e.g., regions 32A, 32B, and 32C or other designated regions, are not limited to an associated ink color or ink type, but rather, may be any regions of printhead 32 for which independent temperature control is desired.

In the present embodiment, printhead temperature sensors 34A, 34B, and 34C measure the temperature of regions 32A, 32B, and 32C, respectively. Temperature data from printhead temperature sensors 34A, 34B, and 34C is employed in accordance with the present invention to independently control and maintain the temperature of regions 32A, 32B, and 32C, respectively, of printhead 32.

An exemplary configuration of printhead 32 includes a cyan nozzle plate 40 corresponding to a cyan ink ejector array 42, a yellow nozzle plate 44 corresponding to a yellow ink ejector array 46, and a magenta nozzle plate 48 corresponding to a magenta ink ejector array 50, for respectively ejecting cyan (C) ink, yellow (Y) ink, and magenta (M) ink. In the present embodiment, cyan ink ejector array 42, yellow ink ejector array 46, and magenta ink ejector array 50 correspond to regions 32A, 32C, and 32B, respectively.

Printhead 32 may include a printhead memory 52 for storing information relating to printhead 32 and/or ink jet apparatus 14. For example, memory 52 may be formed integral with printhead 32, or may be attached to printhead cartridge 38.

As further illustrated in FIG. 2, printhead carrier 30 is controlled by controller 22 to move printhead 32 in a reciprocating manner in main scan direction 36, with each left to right, or right to left movement of printhead carrier 30 along main scan direction 36 over the sheet of print media 28 being referred to herein as a pass. The area traced by printhead 32 over sheet of print media 28 for a given pass will be referred to herein as a swath, such as for example, swath 54 as shown in FIG. 2. The sheet of print media 28 may be advanced between passes in a media feed direction 56.

In the exemplary ink ejector configuration for ink jet printhead 32 shown in FIG. 2, each of ink ejector arrays 42, 46, and 50 include a plurality of ink ejectors 58, with each ink ejector 58 having a nozzle 59, and having at least one corresponding jetting heater 60.

A swath height 62 of swath 54 corresponds to the distance between the uppermost and lowermost of the nozzles within an array of nozzles of printhead 32. For example, in magenta ink ejector array 50, nozzle 59-1 is the uppermost nozzle and nozzle 59-n is the lowermost nozzle. In the example of FIG. 2, the swath height 62 is the same for each of ink ejector arrays 42, 46 and 50; however, this need not be the case, i.e., it is possible that the swath heights of ink ejector arrays 42, 46 and 50 may be different, either by design or due to manufacturing tolerances.

Controller 22 provides temperature control for printhead 32 by applying non-nucleating heating (NNH) to selected ink ejectors 58 to maintain printhead 32 at a desired operating temperature. The NNH heating is applied via current flow through jetting heaters 60 corresponding to the respective selected ink ejectors 58. Ideally, each non-nucleating heating pulse is of duration that a vapor bubble is not formed in the liquid ink, and accordingly, no drop of ink is ejected from the corresponding ink ejector 58. Rather than ejecting ink, the intent of the NNH heating in accordance with the present invention is to maintain a desired bulk printhead temperature.

However, it is desirable to apply the NNH heating pulses in such a way as to maximize printhead life (minimize individual heater stress). Accordingly, the present invention provides a method for balancing the application of NNH heating energy across printhead 32 by applying the pulses in a uniform fashion over the entirety of printhead 32, thus spreading the NNH heating load over all ink jetting heaters 58 of printhead 32.

In order to use NNH to control the temperature of printhead 32, it is desirable to be able to modulate the intensity of the applied heat with some granularity. This allows for closed loop control of the temperature of the head, given that temperature sensors 34A, 34B, and 34C may be used for sensing the temperature of the regions 32A, 32B, and 32C, respectively, of the silicon being heated by the applied NNH. The intensity may be modulated in different ways. One way is to modulate the application of pulses applied to the head with a Pulse Width Modulated (PWM) signal having duty cycle can be varied from 0 to 100 percent. The problem with this approach is that during the "ON" cycle of the PWM signal, the PH is being heated at its most intense rate. This may be problematic from the standpoint of the temperature oscillating wildly at the heat source.

To avoid this problem, the method of modulating the intensity of the applied heat in accordance with the present invention includes the use of a configurable "NNH Intensity" digital word, referred to herein as a binary intensity word (BIW), wherein each bit in the word is associated with an address of printhead 32. As set forth below, the binary intensity word is configured by changing its numeric representation, e.g., the number of bits forming the binary intensity word, as well as the number of bits that are set to be active for asserting NNH heating. In the present embodiment, printhead is arranged such that only one subset of the ink ejectors may be addressed during one instance of time, although the present invention is not so limited. Each of these subsets of ink ejectors is referred to as an address. For example, the printhead 32 has 10 distinct addresses corresponding thereto. During a printing operation, controller 22 cycles through a series of N addresses, wherein N=E/S, and wherein N is the total number of address for printhead 32 (which is 10 in the present embodiment), E is the total number of ink ejectors 58 in printhead 32, and S is a number of subgroups of ink ejectors 58, each subgroup being those ink ejectors 58 that are fired during the application of a particular address.

The configurable binary intensity word (BIW) in accordance with the present invention is formed of a plurality of assertable bits that is applied to printhead 32 in parallel with the application of the addresses that govern the firing of ink ejectors 58 for printing. Thus, while sequentially cycling through each address, the BIW is repeatedly cycled in a manner similar to the cycling of addresses. Assertable bits, as used herein, pertains to bits forming the BIW that may be selectively turned on or off (active or inactive, respectively), wherein in the "on" state, the bit activates the jetting heaters of selected ink ejectors 58. Thus, if all the assertable bits in the binary intensity word are active (ON or 1), the heat intensity would be 100%. Conversely, if all bits are inactive (OFF or 0), then the heat intensity would be 0%. If any other number of bits in the intensity word are active, then the heat intensity would be given by the number of active bits divided by the total number of bits. Although in the present embodiment the active bits have a value of 1, it will be understood that the active bits may employ the converse value, i.e., 0, without departing from the scope of the present invention.

Referring now to FIG. 3, a potential a binary intensity word, BIW 64 is depicted along with address cycle 66 that is sequentially repeated during a printing operation, while BIW 64 is repeatedly applied to printhead 32. Although only three address cycles 66 are depicted, i.e., address cycle 66A, address cycle 66B, address cycle 66C, such depiction is for illustrative purposes; it will be understood that address cycle 66 is repeated as required in order to complete the print job. Similarly, the application of the binary intensity word is repeated during the printing operations until the print job is completed.

In the depiction of FIG. 3, there is a plurality of addresses 68, with ten addresses 68 forming address cycle 66, which are numbered 1 through 10, and there are ten assertable bits 70 forming BIW 64, wherein bits selected to be asserted for providing NNH heating are those having a logical value of true, e.g., a logical one, or "on," whereas the bits having a value of zero are not asserted. The bits are asserted for the adjacent addresses, i.e., the corresponding address 68 depicted in FIG. 3 as being located above the bit to be asserted. For example, in FIG. 3, the BIW is 1000010000, wherein bits 70A and 70B are a logical one (ON), and thus, in the first address cycle, e.g., address cycle 66A, bits 70A and 70B, which are the active bits, activate NNH heating for addresses 68A and 68B.

It is seen from the depiction of FIG. 3 that in each of address cycle, e.g., address cycles 66A, 66B, and 66C, the same addresses 68A and 68B are activated by bits 70A and 70B, respectively, which results in an unbalanced heating operation. That is, addresses 68A and 68B, depicted as addresses 1 and 6, respectively, for this pattern would be driven at 100 percent while all other addresses 68 are not driven at all. Because the same addresses, and hence the same corresponding ink ejectors 58, are repeatedly used for maintaining the desired printhead operating temperature, the life of those ink ejectors 58 would be reduced relative to the ink ejectors 58 that are not used for NNH heating. In addition, the NNH heating is not uniformly applied to printhead 32, which would result in temperature variations across printhead 32, as well as degraded print quality due to the corresponding temperature disparity between the different areas of the printhead that are warmed by the NNH heating.

Choosing the total number of bits (assertable bits) for the binary intensity word should be performed wisely in order to provide balanced application of NNH heating. As seen in FIG. 3, if the length of the BIW, i.e., the number of assertable bits, is equal to the number of printhead addresses, the bits that are asserted will be applied to the same addresses cycle after cycle after cycle of the printhead. This would not be a balanced application of NNH.

It is desirable from for both printhead life considerations and print quality considerations that the NNH heating be applied uniformly throughout printhead 32, such that the NNH heating pulses are uniformly distributed among all of ink ejectors 58. Thus, the total number of assertable bits 70 should be chosen so as to provide balanced application of NNH. From FIG. 3, it is clear that the number of assertable bits, which is the length of the BIW, is equal to the number of printhead addresses, and thus the bits that are asserted will be applied to the same addresses cycle after cycle after cycle of the printhead, which does not result in balanced application of NNH.

To avoid such a problem, the present invention uses binary intensity word lengths, i.e., number of assertable bits, other than the number of addresses associated with printhead 32. Preferably, the number of asserted bits is one more or one less than the number of addresses associated with printhead 32.

For example, referring now to FIG. 4, BIW 72 is depicted along with address cycle 66, with BIW 72 being repeatedly applied to printhead 32 while cycling through the plurality of addresses, e.g., address cycle 66A, address cycle 66B, address cycle 66C. BIW 72 includes a configurable plurality of assertable bits 74 for modulating the non-nucleating heating from a minimum value, e.g., 0% NNH heating to a maximum value, e.g., 100% NNH heating. BIW 72 includes a configurable length given by the number of assertable bits 74.

In order to provide balanced NNH heating of printhead 32, BIW 72 is configured to apply NNH heating via a selected number of assertable bits 74 to one or more different addresses of plurality of addresses 68 for each successive cycling through plurality of addresses 68, i.e., each pass through address cycle 66. The selected number of assertable bits that are applied, e.g., are active, ranges from zero to the total number of assertable bits forming BIW 72, depending upon measured temperature conditions of regions 32A, 32B, and 32C.

BIW 72 has a configurable length given by a configurable plurality of assertable bits 74 for modulating NNH heating from a minimum intensity value to a maximum intensity value. The heat intensity provided to printhead 32 is given by the number of bits that are active divided by the total number of bits in BIW 72. As set forth above, if all the assertable bits in BIW are active (ON or 1), i.e., all bits are to be asserted for providing NNH heating, the heat intensity applied to printhead 32 would be 100%, whereas if all bits are inactive (OFF or 0), then the heat intensity would be 0%. The length of BIW 72 is configured such that the number of assertable bits 74 forming BIW 72 is different than the number of addresses forming the plurality of addresses, i.e., the number of addresses in address cycle 66. Preferably, the number of assertable bits 74 forming BIW 72 is different than the number of addresses forming plurality of addresses 68 by a value equal to one. In the embodiment depicted in FIG. 4, the length of BIW 72 is nine bits, i.e., nine assertable bits 74, yielding a BIW value of 100001000, whereas the number of addresses 68 in address cycle 66 is ten. The NNH heating intensity given by the depicted BIW 72, given by the number of active bits (the bits to be asserted for NNH heating) divided by the total number of assertable bits is 2/9, i.e., 22.2%. It will be understood that in accordance with the present invention, the NNH intensity applied via BIW 72 may change from one pass through address cycle 66 to the next, depending upon the amount of NNH heating required to maintain the desired printhead operating temperature, as well as the temperature of individual regions 32A, 32B, and 32C of printhead 34.

As seen from FIG. 4, addresses 68A, 68B, and 68C (addresses 1, 6, and 10, respectively, of the 10 addresses forming plurality of addresses 68) are energized for NNH heating on the first address cycle 66, i.e., address cycle 66A due to the assertion of active bits 74A and 74B. However, due to the selected length of BIW 72, on the second address cycle 66, i.e., address cycle 66B, the NNH heating is applied via assertable bits 74A and 74B to different addresses, e.g., addresses 68D and 68E (addresses 5 and 9 respectively, of the 10 addresses forming plurality of addresses 68). This progression continues, such that each address 68 is eventually activated for NNH heating by BIW 72 controller 22 cycles through each address forming plurality of addresses 68.

For example, on the third address cycle 66, i.e., address cycle 66C, NNH heating is applied to addresses 68F and 68G (address Nos. 4 and 8 respectively, of the 10 addresses forming plurality of addresses 68) via active bits 74A and 74B, and on the fourth address cycle, NNH heating is applied to address Nos. 5 and 9 respectively, of the 10 addresses forming plurality of addresses 68, and so on. Thus, the selected length of BIW 72 allows for a completely balanced application of the desired NNH heating intensity. Other lengths can be chosen in keeping with the present invention, however in order to maintain balance certain rules may be applied. For example, such rules may include that the length of BIW 72 is not equal to the number of addresses, is not a factor of the number of addresses in plurality of addresses 68 forming address cycles 66, and is not divisible by the number of addresses in plurality of addresses 68 forming address cycles 66, i.e., to yield an integer result.

Figure 5A:
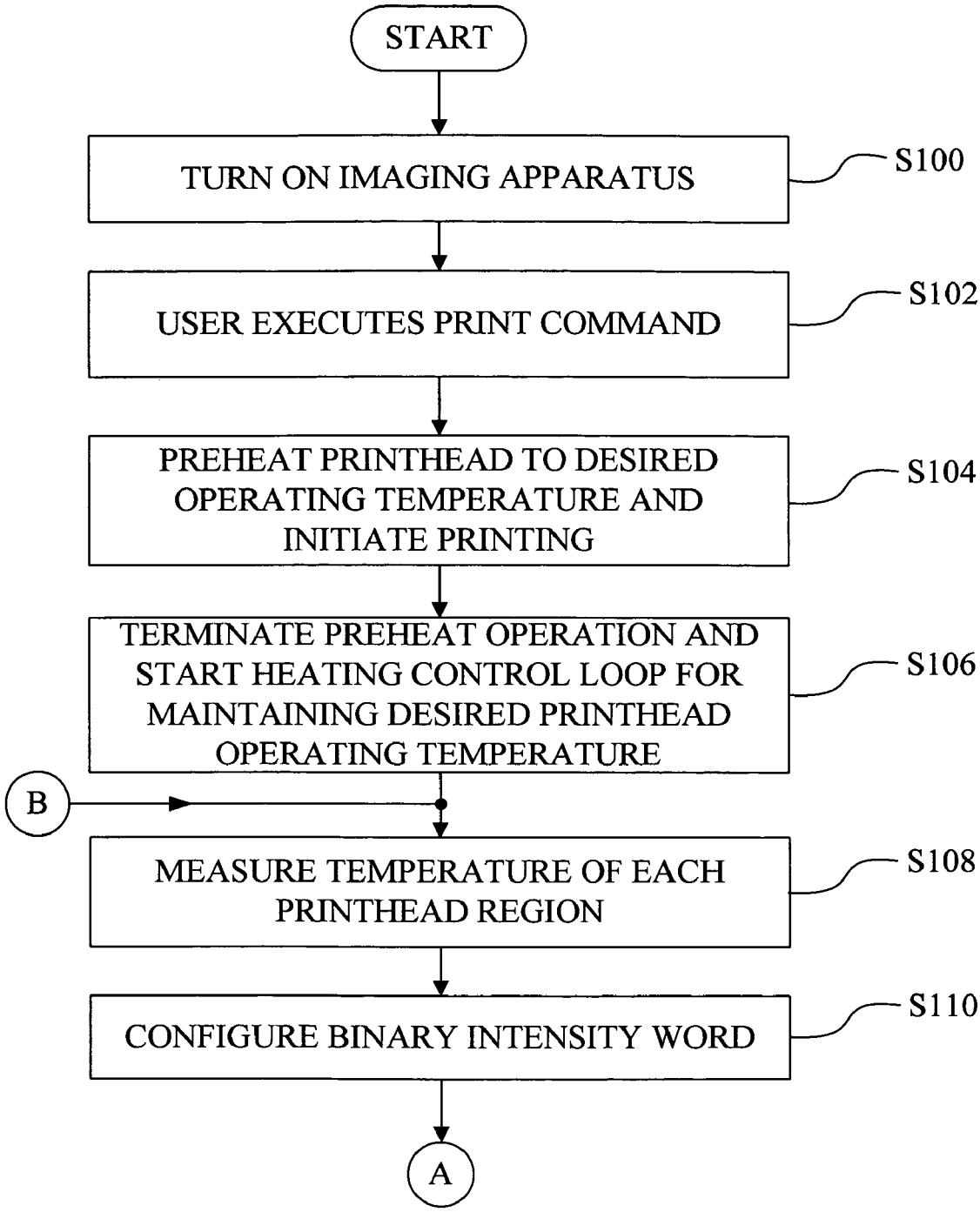
FIGS. 5A and 5B are a flowchart depicting a method for controlling a printhead in accordance with the present invention.
Figure 5B:
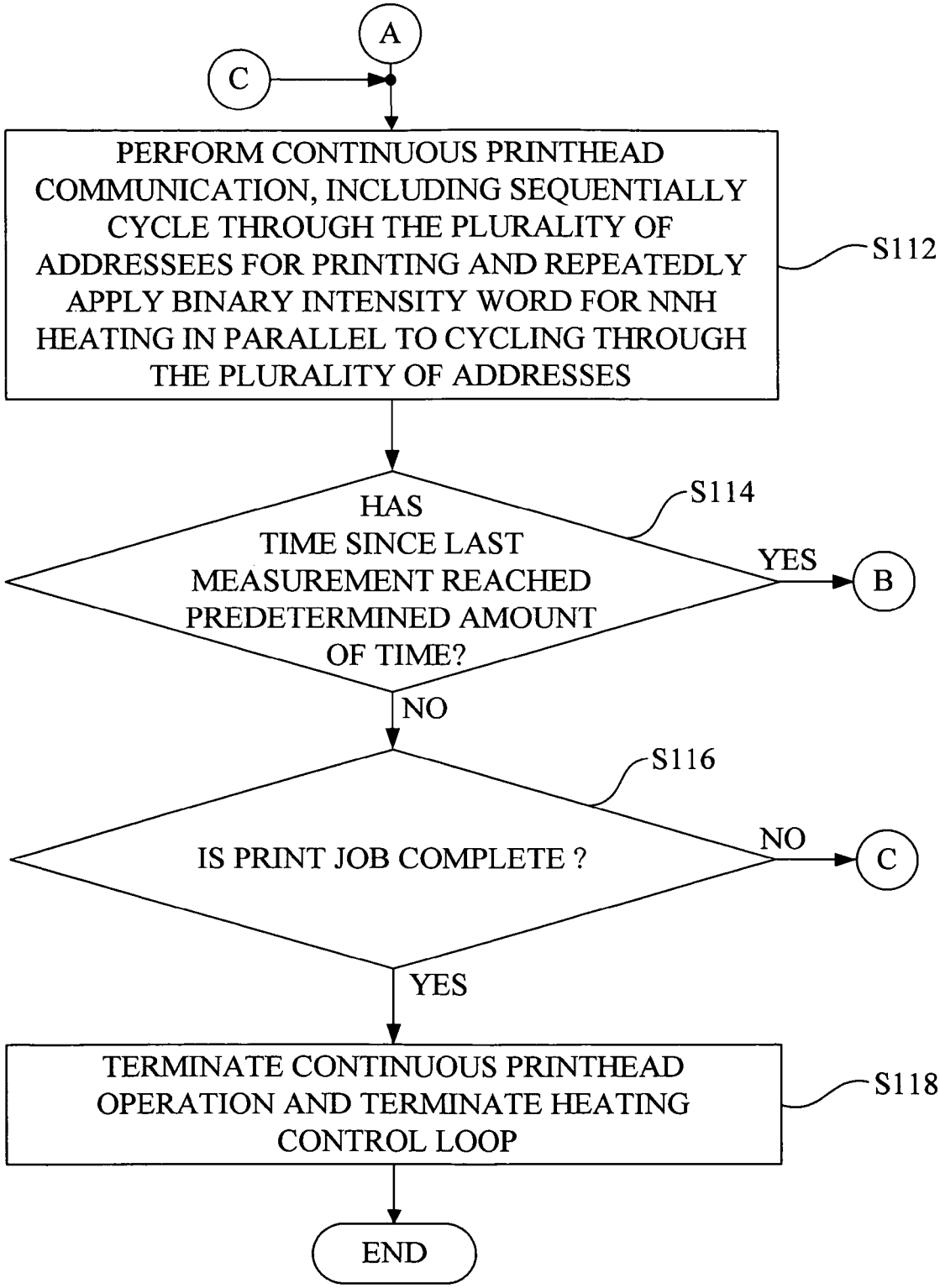

Referring now to FIGS. 5A and 5B, a method for controlling printhead 32 for printing and maintaining a desired operating temperature of printhead 32 during printing in accordance with the present invention, is depicted. Unless otherwise indicated, each step is performed by controller 22 executing program instructions, for example, as part of imaging driver 20.

At step S100, a user turns on ink jet apparatus 14, and controller 22 executes instructions to translate printhead carrier 30 with printhead 32 into a starting position in preparation for printing.

At step S102, the user executes a print command to print a document, for example, using conventional word or image processing software operating on computer 12.

At step S104, printhead 32 is preheated to a desired operating temperature, and then a printing operation is initiated. In the present embodiment, the desired operating temperature of printhead 32 is 42° C.

At S106, the preheat operation of step S104 is terminated, and heating control for maintaining the desired printhead operating temperature of printhead 32 is started. In addition, continuous communication with printhead 32 is started.

At step S108, the temperatures of regions 32A, 32B, and 32C are measured using temperature sensors 34A, 34B, and 34C, respectively.

At step S110, BIW 72 is configured for applying non-nucleating heating to selected ink ejectors 58 of plurality of ink ejectors of printhead 32. Configuring BIW 72 includes selecting the length of BIW 72 as the configurable length, and selecting from the configurable plurality of assertable bits 74 a number of assertable bits 74 to be asserted for providing a modulated non-nucleating heating of printhead 32. Depending upon the temperatures of the individual regions, e.g., regions 32A, 32B, and 32C, the number of assertable bits 74 asserted for providing the modulated NNH heating may be different, e.g., varies, as between at least two arrays of ink ejectors, e.g., the cyan ink ejector array 42, magenta ink ejector array 50, and yellow ink ejector array 46 corresponding to regions 32A, 32C, and 32B, respectively. The respective temperature associated with each region is determined based a measured temperature corresponding to the region. Alternatively, however, it is contemplated that the temperature may be based on estimated heating data for each region, for example, derived from print data for the document or image being printed. The configuration of BIW 72 may take place at the factory, e.g., a set value implemented in software, firmware, or hardware. However, in the present embodiment, BIW 72 may be configured by controller 22, for example, as shown in FIG. 6.

FIG. 6 depicts an implementation of a NNH density table 76 in hardware, e.g., in an application specific integrated circuit (ASIC). NNH density table 76 typically may be configurable by firmware, but could be hard coded to save gates. NNH density table 76 has N+1 entries, each of which is N bits wide, where N is the width of the binary intensity word. For each region of NNH control, e.g., regions 32A, 32B, and 32C of printhead 32, a pointer into the entries of the table exists, such as cyan pointer 79A, magenta pointer 79B, and yellow pointer 79C. These pointers are the registers that firmware uses to control the intensity of heat applied to each NNH region by selecting the appropriate value for BIW 72 based upon temperature conditions of regions 32A, 32B, and 32C. The cycle index is shown to advance every PLOAD (parallel load of print data, e.g., for the next address 68 in address cycle 66). The occurrence of PLOAD during normal Printer to Printhead communication indicates an advance to the next address 68 (e.g., group of jetting heaters 60.)

Figure 7:
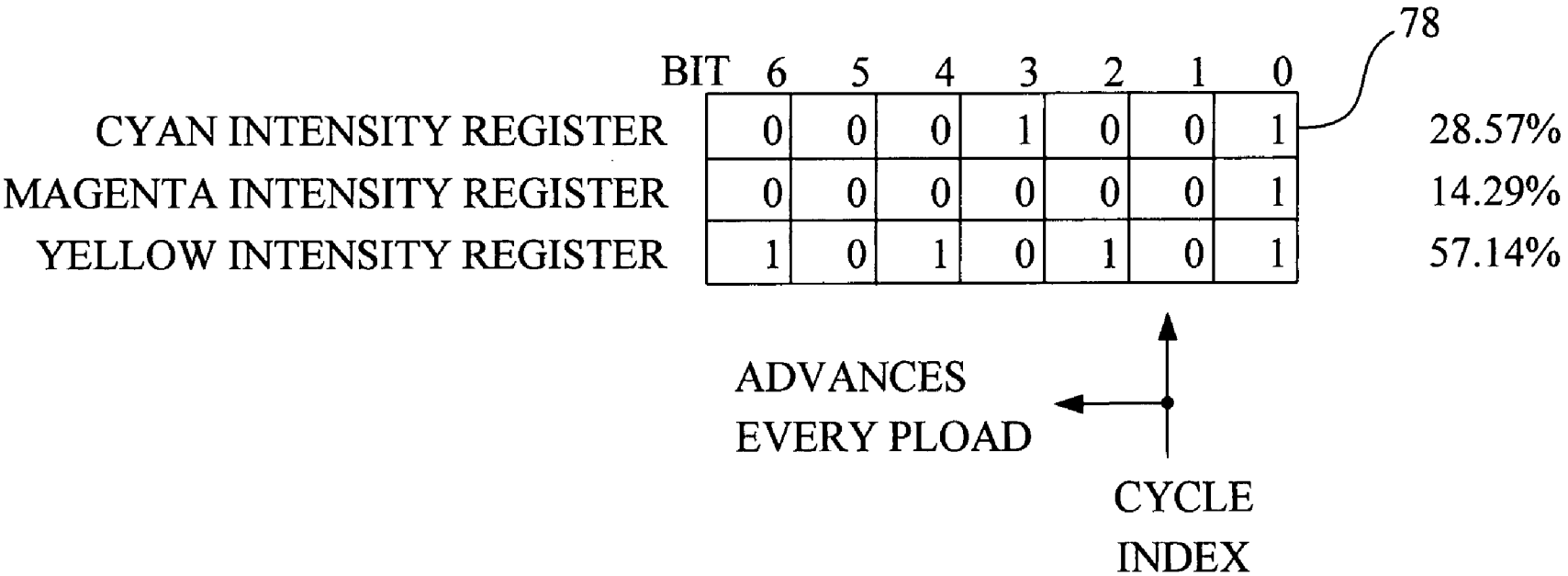
FIG. 7 depicts a non-nucleating density table in accordance with another embodiment of the present invention.

Referring now to FIG. 7, another implementation of step S110 in accordance an embodiment of the present invention is depicted, wherein BIW 72 has a length of 7 assertable bits. The implementation of FIG. 7 operates off of the same premise as that of FIG. 6, except that there is only a single table 78 entry for each of regions 32A, 32B, and 32C. Each table 78 entry is considered as an intensity register for the region in question. In the embodiment of FIG. 7, the intensity information (Intensity words for 0-100% in increments of 1/N) is stored in firmware, then chosen and written to each individual intensity register based on the measured temperature data.

At step S112, continuous communication with printhead 32 is established, including repeatedly sequentially cycling through the plurality of addresses 68 of address cycle 66 for printing with printhead 32, and repeatedly applying BIW 72 for NNH heating in parallel to the repeated sequentially cycling through the plurality of addresses 68.

At step S114, a determination is made as to whether the time since the last temperature measurement of regions 32A, 32B, and 32C of printhead 32 has reached a predetermined amount of time. In the present embodiment, the predetermined amount of time for the temperature control loop is 10 ms.

At step S116, a determination is made as to whether the print job is complete. If so, process flow proceeds to step S118, otherwise, process flow proceeds to step S112 to continue the print operation via the continuous communication with printhead 32.

At step S118, if the print job is complete, the continuous printhead 32 communication is terminated, and the heating control loop for maintaining the desired printhead operating temperature is terminated.

In summary, an embodiment of the present invention employs intensity registers for each of the NNH Heating Regions (regions 32A, 32B, and 32C of printhead 32. Firmware writes these intensity registers with patterns based on intensity information stored in ROM or RAM and the thermal control algorithm employed. The hardware around these intensity registers contains a cycle index into these intensity words, which advances each printhead address cycle. The hardware also contains the means for extracting the assertable bit from each intensity register pointed to by the cycle index and placing it in the printhead data stream in order to communicate the intensity information to the printhead. The present invention thus allows for the NNH heating at any intensity to be applied uniformly to the printhead, increasing the life of the printhead, and achieving a more uniformly heated printhead.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for controlling a printhead for printing and maintaining a desired operating temperature of said printhead during said printing, said printhead having a plurality of ink ejectors and a plurality of addresses employed for ejecting ink from said plurality of ink ejectors, wherein each address of said plurality of addresses corresponds to a particular subset of said plurality of ink ejectors, comprising:

configuring a binary intensity word for applying non-nucleating heating to selected ink ejectors of said plurality of ink ejectors of said printhead;

repeatedly sequentially cycling through said plurality of addresses for said printing with said printhead; and repeatedly applying said binary intensity word while performing said repeated sequentially cycling through said plurality of addresses.

2. The method of claim 1, wherein:

said binary intensity word includes a configurable plurality of assertable bits for modulating said non-nucleating heating from a minimum value to a maximum value; and wherein said configuring said binary intensity word includes selecting from said configurable plurality of assertable bits a number of assertable bits to be asserted for providing a modulated non-nucleating heating of said printhead.

3. The method of claim 2, wherein:

said plurality of ink ejectors includes a plurality of arrays of ink ejectors; and wherein said number of assertable bits asserted for said modulated non-nucleating heating is different as between at least two arrays of said plurality of arrays of ink ejectors.

4. The method of claim 2, wherein:

said printhead includes a plurality of regions; and said number of assertable bits asserted for providing said modulated non-nucleating heating varies for each region of said plurality of regions in response to a respective temperature associated with said each region.

5. The method of claim 4, wherein said respective temperature associated with said each region is determined based on at least one of a measured temperature corresponding to said each region and estimated heating data for said each region.

6. The method of claim 1, wherein:

said binary intensity word includes a configurable length; and wherein said configuring said binary intensity word includes selecting a length of said binary intensity word as said configurable length.

7. The method of claim 6, wherein said length of said binary intensity word is configured such that a number of assertable bits forming said binary intensity word is different than a number of addresses forming said plurality of addresses.

8. The method of claim 7, wherein said number of assertable bits forming said binary intensity word is different than said number of addresses forming said plurality of addresses by a value equal to one.

9. The method of claim 7, wherein said number of assertable bits forming said binary intensity word is not a factor of said number of addresses forming said plurality of addresses and is not divisible by said number of addresses forming said plurality of addresses.

10. The method of claim 1, wherein said binary intensity word is configured to apply said non-nucleating heating to a different address of said plurality of addresses for each successive cycling through said plurality of addresses.

11. The method of claim 1, wherein:

said binary intensity word includes a configurable length given by a configurable plurality of assertable bits for modulating said non-nucleating heating from a minimum value to a maximum value; and said configuring said binary intensity word includes:

selecting a length of said binary intensity word in the form of a total number of assertable bits defining said configurable plurality of assertable bits; and selecting from said configurable plurality of assertable bits a number of assertable bits to be asserted for providing a modulated non-nucleating heating of said printhead.

12. The method of claim 11, wherein:

said printhead includes a plurality of regions; and said number of assertable bits asserted for providing said modulated non-nucleating heating varies for each region of said plurality of regions in response to a respective temperature associated with said each region.

13. The method of claim 11, wherein said binary intensity word is configured to apply to a different address of said plurality of addresses for each successive cycling through said plurality of addresses.

14. A method for maintaining a desired operating temperature of a printhead during printing, said printhead having a plurality of ink ejectors and a plurality of addresses employed for ejecting ink from said plurality of ink ejectors, wherein each address of said plurality of addresses corresponds to a particular subset of said plurality of ink ejectors, comprising establishing a configurable binary intensity word for applying non-nucleating heating to selected ink ejectors of said plurality of ink ejectors;

cycling through said plurality of addresses for said printing with said printhead;

applying said binary intensity word to said printhead in parallel with said cycling through said plurality of addresses; and modulating said non-nucleating heating by changing a numeric representation of said binary intensity word.

15. The method of claim 14, wherein said binary intensity word includes a configurable plurality of assertable bits, and wherein said changing said numeric representation includes selecting from said configurable plurality of assertable bits a number of assertable bits to be asserted for providing said non-nucleating heating of said printhead.

16. The method of claim 15, wherein said printhead includes a plurality of regions; and wherein said number of assertable bits asserted for providing said modulated non-nucleating heating varies for each region of said plurality of regions in response to a respective temperature associated with said each region.

17. The method of claim 16, wherein said respective temperature associated with said each region is determined based on at least one of a measured temperature corresponding to said each region and estimated heating data for said each region.

18. A method for maintaining a desired operating temperature of a printhead during printing, said printhead having a plurality of ink ejectors and a plurality of addresses employed for ejecting ink from said plurality of ink ejectors, wherein each address of said plurality of addresses corresponds to a particular subset of said plurality of ink ejectors, comprising establishing a configurable binary intensity word for applying non-nucleating heating to selected ink ejectors of said plurality of ink ejectors;

cycling through said plurality of addresses for said printing with said printhead; and applying said binary intensity word to said printhead in parallel with said cycling through said plurality of addresses, wherein said binary intensity word is configured to apply said non-nucleating heating to a different address of said plurality of addresses while cycling through said plurality of addresses.

19. The method of claim 18, wherein said binary intensity word includes a configurable length; and wherein said binary intensity word is configured to apply said non-nucleating heating by selecting a length of said binary intensity word.

20. The method of claim 18, wherein a number of bits forming said binary intensity word is different than said number of addresses forming said plurality of addresses.

* * * * *